United States Patent [19]

Lloyd

[11] Patent Number: 4,790,220

[45] Date of Patent: Dec. 13, 1988

[54] SAFETY SEAL STRIPPER

[76] Inventor: James Lloyd, 2000 South College Ave., Philadelphia, Pa. 19121

[21] Appl. No.: 161,785

[22] Filed: Feb. 29, 1988

[51] Int. Cl.[4] ..... B67B 7/44

[52] U.S. Cl. ..... 81/3.09

[58] Field of Search ..... 81/3.07, 3.09, 3.4.3.48; 30/1.5; 7/151, 156

[56] References Cited

U.S. PATENT DOCUMENTS

| | | | |
|---|---|---|---|
| 2,262,000 | 11/1941 | Hjort | 30/1.5 |
| 2,896,317 | 7/1959 | Vaive | 30/1.5 |
| 4,455,894 | 6/1984 | Roberts | 81/3.09 |
| 4,723,465 | 7/1988 | Hughes | 81/3.09 |

FOREIGN PATENT DOCUMENTS

| | | | |
|---|---|---|---|
| 2159275 | 6/1973 | Fed. Rep. of Germany | 30/1.5 |
| 1051041 | 10/1983 | U.S.S.R. | 30/1.5 |

*Primary Examiner*—Roscoe V. Parker

*Attorney, Agent, or Firm*—Benasutti and Murray

[57] ABSTRACT

An apparatus which enables the user to easily remove a bottle cap having a safety seal from a container such as a milk or juice container. The apparatus fits over the cap and safety seal unit and allows the user to easily separate the safety seal from the bottle cap by rotation of the apparatus with respect to the cap. Neither the cap or bottle is deformed so that the cap may be used to reseal the container after separation of the safety seal.

11 Claims, 1 Drawing Sheet

SAFETY SEAL STRIPPER

BACKGROUND OF THE INVENTION

1. Field of the Invention

This invention relates generally to the area of container cap removers and more particularly to the area of bottle cap removers for bottle caps having a safety seal.

2. Description of the Prior Art

Apparatus have long been available for prying off compression fit bottle caps. Bottle cap removers for traditional soft drink and beer bottles are prominent examples. More recently, there has been a movement away from the use of bottle caps which require such removers. Many containers are available with compression fit caps which may be screwed off as well as pried off. Plastic containers, such as milk containers are available with caps that may be unscrewed. Such caps, however, provide only a limited certainty of complete seal under normally experienced conditions of transportation and/or storage. In response to this problem, bottlers have resorted to the use of threaded caps which include a safety seal. Hereinafter, such threaded caps will be called "safety caps". The safety seal holds a cap secure until the consumer purposefully opens the container. The soft drink type and milk, water or juice container type threaded safety caps predominate this class of container closures.

In the typical soft drink container type safety cap, the safety seal is broken by the use of moderate force applied when initially unscrewing the cap to fracture the safety seal. Standard milk, water or juice container type safety seals are designed to be removed prior to unscrewing the cap. Here, it is necessary to first separate a sealing ring from a safety cap before the cap may be removed from the container. This can be a difficult task for all but those with strong hands and strong fingernails. The present invention provides an apparatus to easily remove such a safety cap by easily separating the sealing ring from the cap so that the cap may be used for resealing the container.

A typical milk, water or juice container includes an externally threaded neck opening which stands above the liquid level of the container. The external threads are designed to mate with internal threads formed on the inner wall of a removeable cap. Immediately below the threaded portion of the container neck, the neck is circumscribed by a set of angled teeth. These teeth are arranged so as to align, in a ratcheting arrangement, with angled, internal teeth on a removeable safety seal releaseably attached to the safety cap. The interior teeth on the safety seal allow the cap to be easily screwed on to the neck, while resisting efforts to unscrew the cap.

The safety seal is connected to the cap by means of frangible posts which extend downwardly from the cap rim to the safety seal. These posts are designed to be sufficiently durable to resist the separation of the safety seal from the safety cap during the initial sealing of the container and during shipping and storage. At the same time, these posts must be sufficiently severable to allow the user to separate the safety seal from the remaining portion of the cap. Removal of the safety seal from the cap can be difficult.

SUMMARY OF THE INVENTION

The present invention provides apparatus to easily and quickly separate the safety seal from a threaded safety seal cap of the type typically employed on milk, water or juice containers. The apparatus of the present invention is adapted to fit over a cap and engage the safety seal in such a manner as to allow the safety seal to be easily separated from the container cap by means of a rotating action. The apparatus of the present invention removes the safety seal without permanently deforming the cap or the container. After separation of the safety seal from the container, the safety seal may be discarded. The cap may then be used to provide a resealable closure for the container.

An objective of the present invention is to provide an apparatus for separating a safety seal from a safety cap on a plastic container. It is another objective of the present invention to provide an apparatus for separating a safety seal from a milk, water, juice or similar container. It is another objective of the present invention to reduce the difficulty of initially separating a safety seal from a safety cap, such that the seal can be readily removed by those with weak or arthritic hands. It is another objective of the present invention that initially separating the safety seal from a safety cap may be made easier. It is another objective of the present invention to provide an apparatus to separate a safety seal from a safety cap without permanently deforming the cap or the container.

DESCRIPTION OF THE PREFERRED EMBODIMENT

Figure 1:
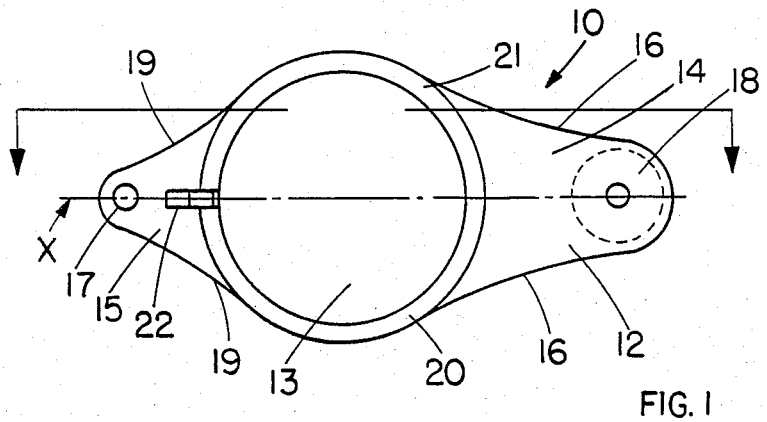
FIG. 1 is a bottom plan view of my invention.
Figure 2:
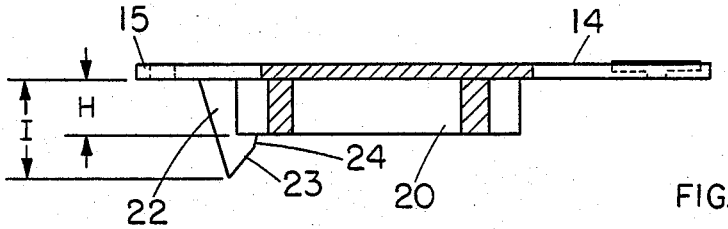
FIG. 2 is a cross sectional side view along line 2—2 of FIG. 1.

Although specific forms of the present invention have been selected for illustration in the drawings, and the following description is drawn in specific terms for the purpose of describing these forms of the invention. This description is not intended to limit the scope of the invention which is defined in the appended claims.

The apparatus 10 of the present invention is shown generally in FIG. 1. The apparatus 10 includes a base 12 which is preferably planar and has the general shape of an oval. The shape of base 12 includes a roughly circular center area 13 having tabs or ears extending radially outwardly in opposite directions. A first tab 14 is preferably longer than a second tab 15. Slightly concave sides 16 and 19 of tabs 14 and 15 respectively, allow the apparatus 10 to fit comfortably in the hand of the user. In use, the base of the user's thumb is oriented in the concave area 16 of tab 14 with the thumb curling about the circular center area 13 and engaging the concave area 19 of tab 15. The symmetry of the apparatus 10 along the longitudinal center line X allows for use of the apparatus in either the right or left hand. First tab 14 or second tab 15 may include storage means such as an opening 17, a hook (not shown) or a ferromagnet 18 to allow hanging of the apparatus. Orientation of a ferromagnet 18 on one of the tabs 14 or 15 enables the user to "store" the apparatus on a metallic surface such as a refrigerator in a well known manner. The apparatus 10 may include both an opening 17 and a ferromagnet 18 as shown.

Figure 3:
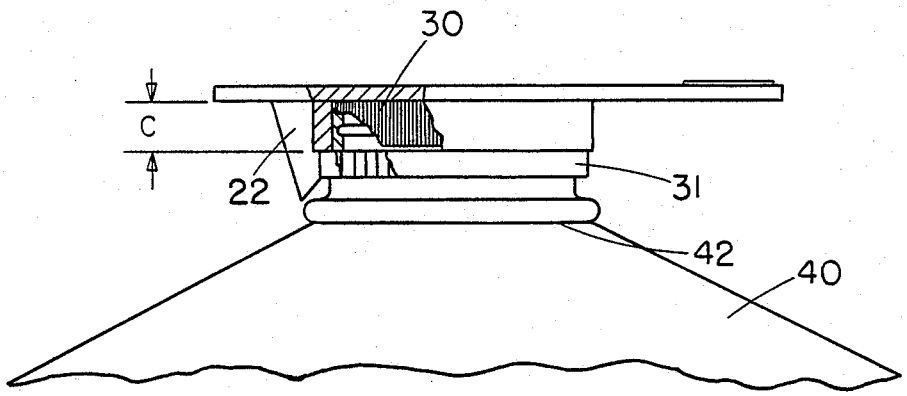
FIG. 3 is a side view, partially in section, of my invention oriented upon a container having a safety cap.

Extending from the circular center area 13 is a cap engagement means such as engagement ring 20. Cap engagement ring 20 is adapted to fit over a cap 30 having a safety seal 31, see FIG. 3. The cap engagement ring 20 preferably comprises a tubular ring 21 extending perpendicularly from the planar cap contacting surface of center circular area 13 of apparatus 10 as shown. The cap engagement ring 20 has a heigth H approximately equal to the heigth C of cap 30. Cap engagement ring 20 has a radius R slightly larger than the radius of cap 30 so that cap engagement ring 20 may be fitted over cap 30. The heigth H and radius R of cap engagement ring 20 allow the apparatus to be fitted over a cap 30 while allowing rotational movement between cap 30 and the apparatus 10. While the cap engagement ring 20 is shown as a tubular ring 21, other arrangements of cap engagement means may be provided. For example, an arcuate section comprising less than a full circle (not shown) or two or more individual posts or arcuate sections (not shown) may be employed.

Figure 4:
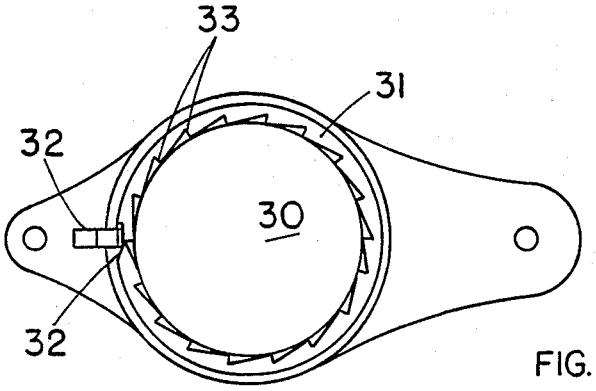
FIG. 4 is a bottom plan view of a typical safety cap oriented in my invention.

Extending from base 12, in the same direction as cap engagement ring 20, is a safety seal engagement means 22. Safety seal engagement means 22 preferably comprised a finger 23 which extends from base 12 along the cap engagement ring 20 for a distance I, greater than the heigth H of cap engagement ring 20. Finger 23 is adapted to fit within a notch 32 formed in a safety seal, see FIG. 4.

Safety seal 31 is fixed to cap 30 by frangible means such as posts 33 in a manner known in the art. Safety seal 31 comprises a ring having inwardly extending angular teeth adapted to engage outwardly extending angular teeth formed on the neck of the container 40. The teeth on the safety seal engage the teeth on the neck of the container in a ratcheting action which allows a safety cap comprising cap 30 with safety seal 31 attached thereto to be easily threaded on to the neck 42 of the container. The engagement of the inwardly and outwardly extending teeth resist efforts to unscrew the cap 30. The safety seal 31 is formed with a notch 32 or slot therein which facilitates separation of the safety seal 31 from the cap 30. The finger 23 of safety seal engagement means 22 is adapted to fit within notch 32 when the apparatus 10 is oriented upon a cap 30, see FIG. 3. When apparatus 10 is oriented upon a cap 30, circular area 13 is oriented substantially parallel to the top surface of cap 30. The finger 23 of safety seal engagement means 22 includes an angled surface 24, such that upon engagement of apparatus 10 with the cap 30 the finger 23 of safety seal engagement means 22 does not engage the outwardly extending teeth on container 40.

Upon orientation of cap engagement ring 20 about a cap 30 with the finger 23 of safety seal engagement means 22 oriented in notch 32, rotation of the apparatus 10, preferably counter-clockwise, separates the safety seal 31 from the cap 30 by severing the frangible posts therebetween. Upon separation of the safety seal 31 from the container cap 30, the safety seal 31 may be discarded. In addition, finger 23 may be employed to puncture a second hermetic seal commonly oriented across the openings of water and juice containers.

The apparatus 10 of the present invention may be formed from any suitable materials such as plastic, metal or wood. Preferably, the apparatus 10 of the present invention is molded from a relatively stiff plastic such as polyvinyl chloride, polypropylene, or polyethylene.

The present invention, as described, is well adapted to carry out the objects and obtain the added advantages mentioned, as well as those inherent herein. While a presently preferred embodiment of the present invention has been described in detail for purposes of disclosure, numerous changes in details of construction, and arrangement of parts can be made which will readily suggest themselves to those skilled in the art and which are encompassed within the spirit of the invention and the scope of the appended claims.

I claim:

1. An apparatus for stripping a safety seal from a safety cap, said apparatus comprising:

a cap engagement means adapted to engage a safety cap and allow rotational movement between said safety cap and said said apparatus; and safety seal stripper means extending from said cap engagement means so as to project into a notch in said safety seal upon engagement of said safety cap by said cap engagement means such that upon rotational movement of said apparatus with respect to said safety cap, said safety seal is separated from said safety cap.

2. The apparatus according to claim 1, wherein said cap engagement means comprises a cap engaging ring, extending from a cap contacting surface, to surround said safety cap upon engagement therewith.

3. The apparatus according to claim 2, wherein said safety seal stripper means comprises a finger extending from said cap engaging ring such that upon orientation of said cap engagement ring around said safety cap, said finger extends into a notch in said safety seal.

4. The apparatus according to claim 2, wherein upon engagement of said cap engagement means with a safety cap, said cap contacting surface is oriented substantially parallel to and adjacent said top surface of said safety cap.

5. The apparatus according to claim 1, further including gripping means, comprising a handle, extending from said cap engagement means.

6. The apparatus according to claim 5, further including hanging means oriented on said handle.

7. The apparatus according to claim 6, wherein said hanging means comprises a hole in said handle.

8. The apparatus of claim 6, wherein said hanging means comprises a ferromagnet element oriented on said handle.

9. An apparatus for removing a safety seal from a container having a safety cap, said apparatus comprising;

a cap engagement means comprising a cap contacting surface and a cap engagement ring extending from said cap contacting surface, said cap engagement means adapted to engage a safety cap and allow rotational movement between said cap and said apparatus;

gripping means extending from said cap engagement means;

storage means oriented on said gripping means;

safety seal stripper means extending from said cap engagement means, such that upon engagement of a safety cap by said cap engagement means, said safety seal stripper means is oriented in a notch in said safety seal and said cap contacting surface is oriented substantially parallel to and adjacent the top surface of said safety cap, such that upon rotational movement of said apparatus with respect to said cap, said safety seal is separated from said safety cap.

10. The apparatus of claim 9, wherein said storage means comprises a hole in said handle.

11. The apparatus of claim 9, wherein said storage means comprises a ferromagnetic element oriented on said handle.

* * * * *